US009370684B2

(12) United States Patent
Poe et al.

(10) Patent No.: US 9,370,684 B2
(45) Date of Patent: Jun. 21, 2016

(54) ELASTIC BAND RETENTION SYSTEM

(71) Applicant: Total Manufacturing Solutions, Inc., Knoxville, TN (US)

(72) Inventors: Charles A. Poe, Athens, TN (US); Steve Peterson, Knoxville, TN (US); Ryan Peterson, Knoxville, TN (US)

(73) Assignee: Total Manufacturing Solutions, Inc., Knoxville, TN (US)

( * ) Notice: Subject to any disclaimer, the term of this patent is extended or adjusted under 35 U.S.C. 154(b) by 137 days.

(21) Appl. No.: 14/485,165

(22) Filed: Sep. 12, 2014

(65) Prior Publication Data

US 2015/0072840 A1 Mar. 12, 2015

Related U.S. Application Data

(60) Provisional application No. 61/877,076, filed on Sep. 12, 2013.

(51) Int. Cl.
*A63B 21/02* (2006.01)
*A63B 21/055* (2006.01)

(52) U.S. Cl.
CPC ..... *A63B 21/0557* (2013.01)

(58) Field of Classification Search
CPC ..... A63B 21/055; A63B 21/0552; A63B 21/0555; A63B 21/0557; A63B 21/0442; A63B 21/00043; A63B 21/02; A63B 21/028; A63B 21/04; A63B 21/0414; Y10T 24/47; Y10T 24/4736; Y10T 24/4745; Y10T 24/4755; Y10T 24/4764; Y10T 24/4773
See application file for complete search history.

(56) References Cited

U.S. PATENT DOCUMENTS

| | | | | | |
|---|---|---|---|---|---|
| 1,539,569 | A * | 5/1925 | Hubert | A63B 21/0004 | 482/125 |
| 1,815,863 | A * | 7/1931 | Noe | A63B 21/0004 | 482/126 |
| 3,589,721 | A * | 6/1971 | Cronauer | A63B 21/0004 | 482/125 |
| 5,638,584 | A * | 6/1997 | De Anfrasio | B62J 7/08 | 24/265 H |
| 5,853,356 | A * | 12/1998 | David | A63B 21/0004 | 482/121 |
| 6,868,586 | B1 * | 3/2005 | Hall | A63B 21/0552 | 24/115 A |
| 7,712,195 | B1 * | 5/2010 | Selby | F16G 11/00 | 24/265 H |
| 2007/0197357 | A1 * | 8/2007 | Ko | A63B 21/0004 | 482/126 |
| 2012/0006637 | A1 * | 1/2012 | Buller | A45C 13/22 | 190/115 |
| 2013/0116098 | A1 * | 5/2013 | Lee | F16B 2/10 | 482/121 |

* cited by examiner

*Primary Examiner* — Oren Ginsberg
*Assistant Examiner* — Nyca T Nguyen
(74) *Attorney, Agent, or Firm* — Pitts & Lake, P.C.

(57) ABSTRACT

An elastic band or elastic strap retention system, used for example in exercise equipment, encompasses a pin with one end of the elastic strap wrapped around the pin and with a series of hog rings or other fastening devices encircling the wrapped assembly of elastic strap end and pin. The assembly is encapsulated in a ridged thermoplastic or thermoset resin system in order to inhibit the movement of the hog rings or other components of the assembly. The resulting attachment is stronger than the elastic material of the elastic strap.

12 Claims, 3 Drawing Sheets

ELASTIC BAND RETENTION SYSTEM

CROSS-REFERENCE TO RELATED APPLICATIONS

This application claims the benefit of U.S. Provisional Patent Application Ser. No. 61/877,076, filed Sep. 12, 2013, the entirety of which is incorporated herein by reference.

STATEMENT REGARDING FEDERALLY SPONSORED RESEARCH OR DEVELOPMENT

Not Applicable

BACKGROUND OF THE INVENTION

1. Field of Invention

This invention pertains generally to exercise equipment and, more particularly, to an attachment system used to retain an elastic strap.

2. Description of the Related Art

Attaching elastic straps to a member can be challenging. The attachment must have minimal impact on the integrity of the elastic in order to prevent the elastic material from severing. Typical mechanical attachment systems using clamps can become loose as the elastic is extended, allowing the elastic to "jack" out as it cycles. This cycling of the elastic stretching reduces the thickness and width of the elastic strap, allowing the elastic strap to undo until the attachment fails—potentially with serious safety consequences or problems.

BRIEF SUMMARY OF THE INVENTION

Some example embodiments according to the present general inventive concept encompass a pin with one end of the elastic strap wrapped around the pin and with a series of hog rings or other fastening devices encircling the wrapped assembly of elastic strap end and pin. The assembly is encapsulated in a ridged thermoplastic or thermoset resin system in order to inhibit the movement of the hog rings or other components of the assembly. The resulting attachment is stronger than the elastic material of the elastic strap.

In some example embodiments of the present general inventive concept, an elastic band retention system includes an elastic band member having at least one end portion, said end portion being wrapped around a retention pin and secured to said retention pin by fastening members, an end unit, said end unit including a cradle to accept said end portion of said elastic band and said retention pin, and an encapsulating resin to secure said end portion of said elastic band and said retention pin within said end unit.

In some embodiments, said end unit includes a handle. In some embodiments, said fastening members include c-clamps. In some embodiments, said fastening members include hog rings. In some embodiments, said cradle includes pores to facilitate the flow of encapsulating resin within said cradle.

In some embodiments, an elastic band retention system further includes a cap member to secure said end portion of said elastic band and said retention pin within said end member. In some embodiments, said cradle and said cap member include pores to facilitate the flow of encapsulating resin within said cradle.

BRIEF DESCRIPTION OF THE DRAWINGS

The above-mentioned and additional features of the invention will become more clearly understood from the following detailed description of the invention read together with the drawings in which.

DETAILED DESCRIPTION OF THE INVENTION

In some of its many embodiments, the present general inventive concept encompasses an elastic band retention system or elastic strap retention system, used for example in exercise equipment, including a pin with one end of the elastic strap wrapped around the pin and with a series of hog rings or other fastening devices encircling the wrapped assembly of elastic strap end and pin. The assembly is encapsulated in a ridged thermoplastic or thermoset resin system in order to inhibit the movement of the hog rings or other components of the assembly. The resulting attachment is stronger than the elastic material of the elastic strap.

Figure 1:
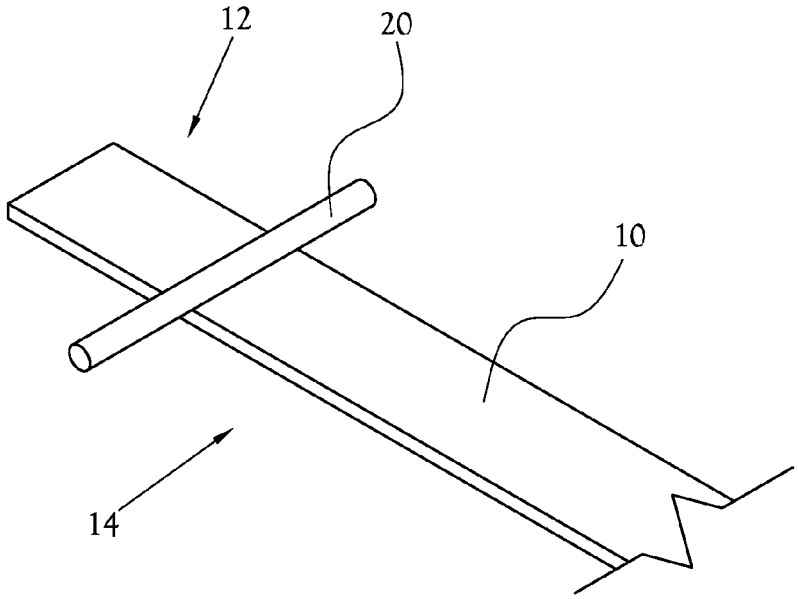
FIG. 1 is a perspective view of one example embodiment of an elastic band and retention pin.
Figure 2:
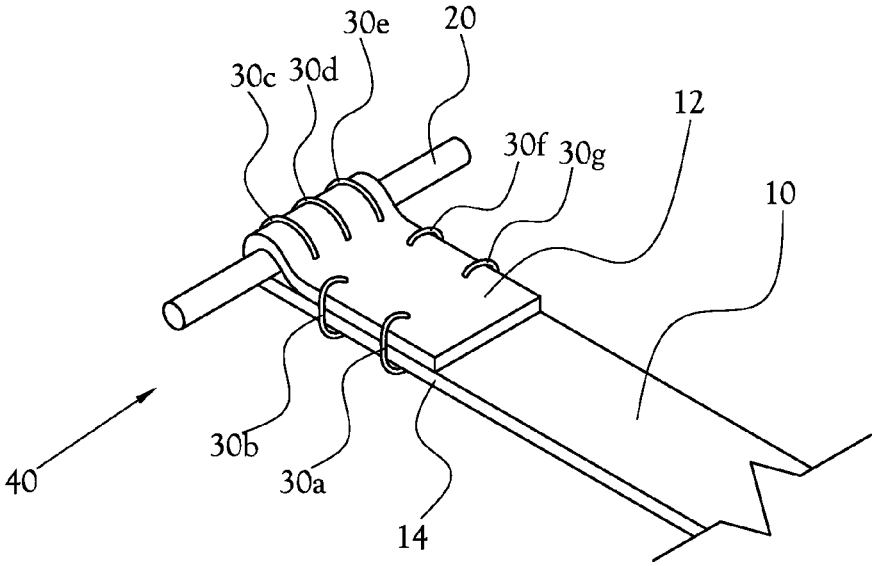
FIG. 2 is a perspective view of the elastic band secured to the retention pin by c-clamps.

Turning to the figures, FIG. 1 illustrates one example embodiment of an elastic band and retention pin to be used in an example embodiment system according to the present general inventive concept. As shown in FIG. 1, the elastic band 10 includes an end portion 12, and when the retention pin 20 is positioned across the width of the elastic band 10 at some point proximate the end portion 12, a second proximal end portion 14 of the elastic band 10 is defined. As shown in FIG. 2, the end portion 12 of the elastic band 10 is wrapped around the retention pin 20, so that the end portion 12 is made to overlap the second proximal end portion 14, and the two portions 12 and 14 of the elastic band 10 are secured to each other and to the retention pin 20 by a number of c-clamps or "hog rings" or retention rings 30*a-g*, generally short lengths of wire fabricated from iron or steel or some similar metal or material. (Hereinafter, "c-clamps" shall be used to encompass all such fastening components or means.) The end portions 12 and 14, the retention pin 20, and the c-clamps 30*a-g* collectively make up a head assembly 40 for the elastic band 10. The use of c-clamps 30*a-g* to secure the elastic band 10 to the retention pin 20 avoids any necessity to sew or penetrate the elastic band material, which might damage or weaken the structural integrity of the elastic band 10.

Figure 3:
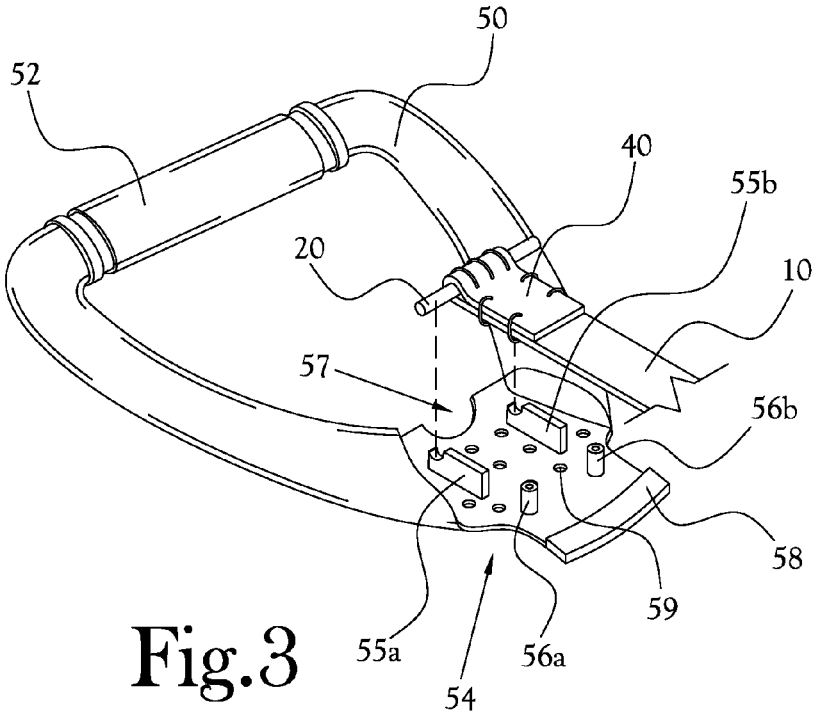
FIG. 3 is a perspective view of one example embodiment of a handle end unit.
Figure 4:
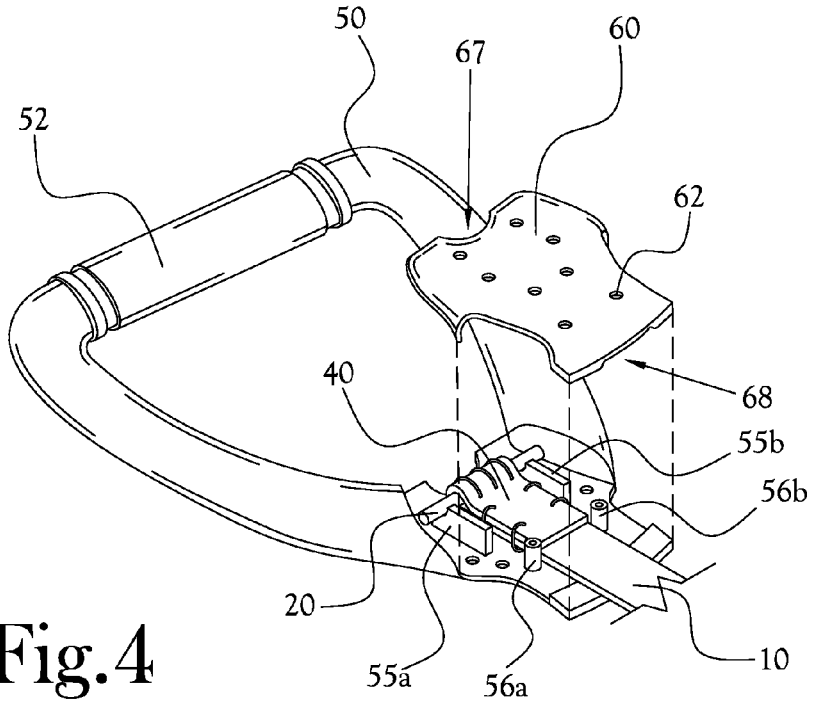
FIG. 4 is a perspective view of the elastic band member secured within the handle end unit, with the cap member positioned above the elastic band member and the handle end unit.

FIG. 3 shows the head assembly 40 positioned proximate the cradle 54 of an example handle end unit 50, which in the illustrated example includes a single handle 52. The cradle 54 includes a pair of mounting members 55*a* and 55*b*, which are configured to receive and retain the exposed end segments of the retention pin 20, and a pair of connecting column members 56*a* and 56*b*, which make contact with and generally interlock with complementary components (not shown) in the cap member 60, as shown in FIG. 4. The cradle 54 generally also includes a head aperture 57 and a base member 58.

Figure 5:
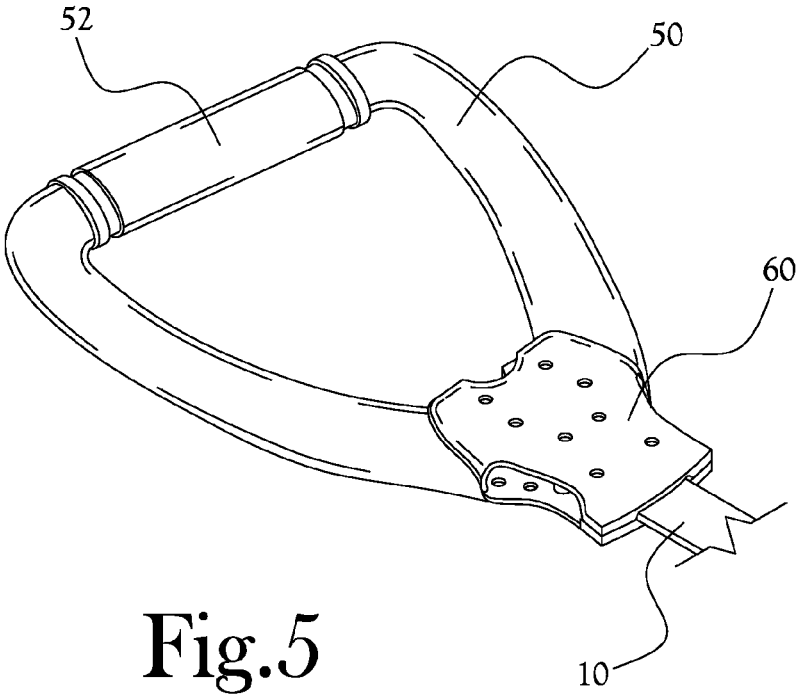
FIG. 5 is a perspective view of the cap member in place on the handle end unit.

As shown in FIG. 4, the head assembly 40 rests within the cradle 54, with the exposed ends of the retention pin 20 resting on the two mounting members 55*a* and 55*b*, and with the elastic band 10 extending away from the cradle 54 between the two connecting column members 56*a* and 56*b* and across the base member 58. The cap member 60 is then mated to a secured to the handle end unit 50, positioned directly over or coupled with the cradle 54, securing the head assembly 40 between the cap member 60 and the cradle 54 portion of the handle end unit 50. In the illustrated example embodiment, the cap member 60 includes a head aperture 67 (which complements the head aperture 57 of the cradle 54) and a base edge 68, which includes a recess, as shown in FIG. 4. When the cap member 60 is secured in place, the elastic band 10 extends away from handle end unit 50 through the gap between the base member 58 and the base edge 68, as shown in FIG. 5.

Figure 6:
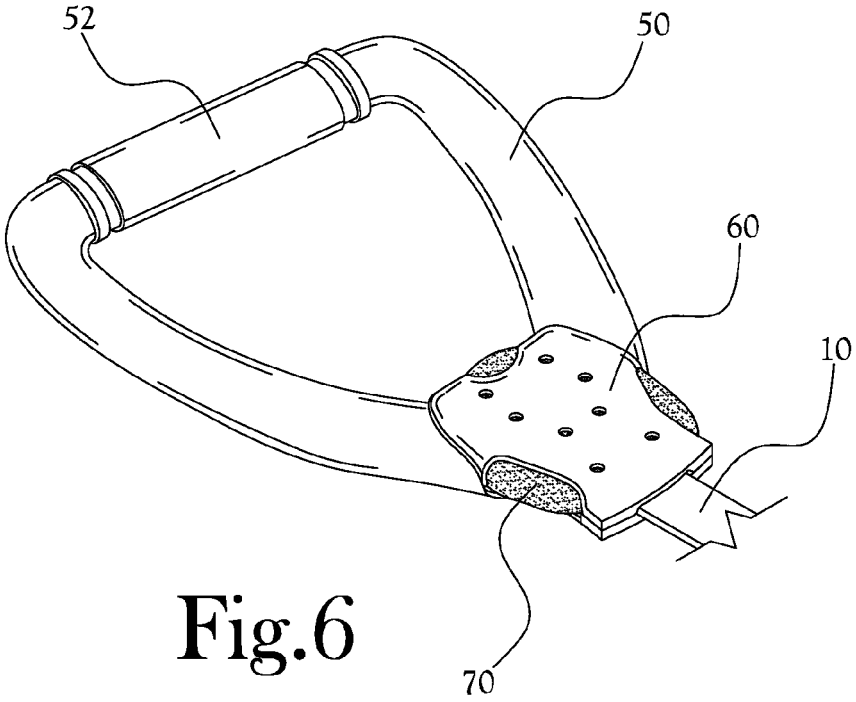
FIG. 6 is a perspective view of the assembly with encapsulating resin applied.

Once the cap member 60 is secured in place, the interior volume defined by the cap member 60 and the cradle 54 is filled with an encapsulation resin 70, as shown in FIG. 6. Generally, the cap member 60 and the cradle 54 include small holes or pores (for example, 59 in FIG. 3 and 62 in FIG. 4), which allow the encapsulation resin to fully fill the interior volume defined by the cap member 60 and the cradle 54. The encapsulation resin immobilizes and encapsulates the head assembly 40 within the handle end unit 50.

In some example embodiments of the present general inventive concept, a method for securing and retaining an elastic band used in exercise equipment includes wrapping an end portion of an elastic band around a pin, securing said end portion to an proximal portion of said elastic band with a fastening member; fitting the end portion of said elastic band and said pin into a cradle configuration to form a retention assembly; encapsulating said assembly in a thermoplastic or thermoset resin to inhibit the movement of said assembly.

Some example embodiments of the present general inventive concept encompass an elastic band retention system for securing an end portion of an elastic band member while allowing another end being extended. In these example embodiments, the elastic band retention system includes a head assembly, said head assembly including an elastic band having a first end portion and a second proximal portion wherein said first end portion is configured to wrap around a retention pin and overlaps said second proximal portion; said head assembly further including at least one fastening member to secure said two portions of said elastic band to each other and to said retention pin; an end unit, said end unit including cradle to receive and retain said head assembly; and a cap member to cover and secure said end unit. In some embodiments, the elastic band retention system of claim further includes an encapsulating resin to secure said head assembly within said end unit.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An elastic band retention system comprising:

an elastic band member having at least one end portion, said end portion being wrapped around a retention pin and secured to said retention pin by fastening members;

an end unit, said end unit including a cradle to accept said end portion of said elastic band and said retention pin; and a cap member to secure said end portion of said elastic band and said retention pin within said end unit;

wherein an interior volume defined by said cap member and said cradle is filled with an encapsulating resin, and wherein said encapsulating resin secures said end portion of said elastic band and said retention pin within said end unit.

2. The elastic band retention system of claim 1 wherein said end unit includes a handle.

3. The elastic band retention system of claim 1 wherein said fastening members include c-clamps.

4. The elastic band retention system of claim 1 wherein said fastening members include hog rings.

5. The elastic band retention system of claim 1 wherein said cradle includes pores to facilitate the flow of the encapsulating resin within said cradle.

6. The elastic band retention system of claim 1 wherein said cradle and said cap member include pores to facilitate the flow of the encapsulating resin within said cradle.

7. An elastic band retention system for securing an end portion of an elastic band member while allowing another end being extended, the elastic band retention system comprising:

a head assembly, said head assembly including an elastic band having a first end portion and a second proximal portion wherein said first end portion is configured to wrap around a retention pin and overlaps said second proximal portion; said head assembly further including at least one fastening member to secure said two portions of said elastic band to each other and to said retention pin;

a handle with an end unit configured to receive and retain said head assembly, said end unit including a cradle to receive said head assembly and to retain an end segment of said retention pin; and a cap member to cover and secure said end unit, wherein an interior volume defined by said cap member and said cradle is filled with an encapsulating resin.

8. The elastic hand retention system of claim 7 wherein said fastening member includes c-clamps.

9. The elastic band retention system of claim 7 wherein said fastening member includes hog rings.

10. The elastic band retention system of claim 7 wherein said cradle includes pores to facilitate the flow of the encapsulating resin within said cradle.

11. The elastic band retention system of claim 7 wherein said cap member include pores to facilitate the flow of the encapsulating resin within said end unit.

12. An elastic band retention system for securing an end portion of an elastic band member while allowing another end being extended, the elastic band retention system comprising:

a head assembly, said head assembly including an elastic band having a first end portion and a second proximal portion wherein said first end portion is configured to wrap around a retention pin and overlaps said second proximal portion; said head assembly further including at least one fastening member to secure said two portions of said elastic band to each other and to said retention pin;

an end unit, said end unit including a cradle to receive and retain said head assembly;

a cap member to cover and secure said end unit; and an encapsulating resin to secure said head assembly within an interior volume defined by said cap member and said end unit.

* * * * *